US007625119B2

(12) United States Patent
Szczesuil et al.

(10) Patent No.: US 7,625,119 B2
(45) Date of Patent: Dec. 1, 2009

(54) FLEXIBLE BAG FOR CONTAINING AND DISPENSING LIQUID

(75) Inventors: Stephen P. Szczesuil, Framingham, MA (US); Kenneth F. Ryan, Jr., Weymouth, MA (US); Robert DiLalla, Worcester, MA (US); Richard Paul Haddad, Hanscom AFB, MA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 358 days.

(21) Appl. No.: 11/509,401

(22) Filed: Aug. 24, 2006

(65) Prior Publication Data

US 2008/0050053 A1 Feb. 28, 2008

(51) Int. Cl.

| | |
|---|---|
| ***B65D 33/00*** | (2006.01) |
| ***B65D 33/16*** | (2006.01) |
| ***B65D 30/00*** | (2006.01) |
| ***B65D 30/08*** | (2006.01) |

(52) U.S. Cl. ..... 383/41; 383/66; 383/97; 383/105; 383/108; 383/111; 383/906

(58) Field of Classification Search ..... 383/66, 383/22, 25, 41, 56, 105, 108, 906; 224/148.1–148.7
See application file for complete search history.

(56) References Cited

U.S. PATENT DOCUMENTS

| | | | | |
|---|---|---|---|---|
| 2,748,047 | A * | 5/1956 | Kuss | 383/66 |
| 3,383,017 | A * | 5/1968 | Krings | 383/66 |
| 3,965,953 | A * | 6/1976 | Becker et al. | 383/66 |
| 4,029,243 | A * | 6/1977 | Zerobnick et al. | 224/681 |
| 4,099,656 | A * | 7/1978 | Neumann et al. | 383/66 |
| 4,213,549 | A * | 7/1980 | Hibbard | 224/601 |
| 5,115,947 | A * | 5/1992 | McDonnell et al. | 383/105 |
| 5,924,172 | A | 7/1999 | Klein | |
| 6,089,789 | A * | 7/2000 | Santamaria | 405/63 |
| 2003/0223657 | A1 * | 12/2003 | Belias et al. | 383/105 |
| 2005/0025393 | A1 * | 2/2005 | Heyniger | 383/66 |

* cited by examiner

*Primary Examiner*—Jes F Pascua
(74) *Attorney, Agent, or Firm*—Vincent J. Ranucci

(57) ABSTRACT

A flexible bag assembly for containment and dispersal of liquids includes a bag having flexible front and back panels, and a peripheral side panel structure interconnecting the front and back panels at sealed seams, the panels defining a chamber for retaining the liquid, a water-proof zipper disposed in the front panel, a detachable cover member fixable to an outside surface of the front panel and adapted to cover the zipper, and a closeable and openable tube extending from within the chamber, through one of the panels and outwardly therefrom, the tube being adapted to facilitate the selective dispersal of the liquid from the bag.

1 Claim, 1 Drawing Sheet

FLEXIBLE BAG FOR CONTAINING AND DISPENSING LIQUID

STATEMENT OF GOVERNMENT INTEREST

The invention described herein may be manufactured and used by the U.S. Government for governmental purposes without the payment of any royalty thereon.

BACKGROUND OF THE INVENTION

1. Field of the Invention

The invention relates to containers for liquids, such as water, and more particularly, to containers which are of rugged construction, sufficient to survive air drops, are flexible so as to be easily stored when empty, inexpensive to manufacture, and adapted for the interior thereof to be easily cleaned.

2. Description of the Prior Art

Current standard containers for soldiers in the field are plastic five gallon cans of relatively rigid construction. The current plastic cans typically do not survive air drops from 100 feet or more, as by helicopters. Also, being generally rigid in construction, such containers, when empty, require essentially the same amount of storage space as when filled. Further, such current containers are difficult to clean in the field inasmuch as access to the interior of the container is limited to the relatively small spout portion of the container. Still further, the cost of current containers is about $42.00 per container, even when mass-produced.

There is thus a need for an improved container which remedies the above shortcomings of current containers in use.

SUMMARY OF THE INVENTION

An object of the invention is, therefore, to provide a container for water or other liquids which can survive a 100+ foot drop (without parachute) without rupturing.

A further object is to provide such a container which is sufficiently flexible to be compressed when empty into a fraction of the space occupied by the container when full.

A further object is to provide such a container affording access to the interior thereof which can be easily cleaned.

A still further object of the invention is to provide such a container which is substantially less expensive to manufacture than the current containers.

With the above and other objects in view, as will hereinafter appear, a feature of the present invention is the provision of a flexible bag assembly for containment and dispersal of liquids. The bag assembly includes a bag having flexible front and back panels, and a peripheral side panel structure interconnecting the front and back panels at sealed seams, the panels defining a chamber for retaining the liquid. A waterproof zipper is disposed in the front panel, and a detachable cover member is fixable to an outside surface of the front panel and adapted to cover the zipper. A closeable and openable tube extends from within the chamber, through one of the panels and outwardly therefrom, the tube being adapted to facilitate the selective dispersal of the liquid from the bag.

The above and other features of the invention, including various novel details of construction and combinations of parts, will now be more particularly described with reference to the accompanying drawings and pointed out in the claims. It will be understood that the particular bag assembly embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawing in which is shown an illustrative embodiment of the invention, from which its novel features and advantages will be apparent.

In the drawing.

DESCRIPTION OF THE PREFERRED EMBODIMENTS

Figure 1:
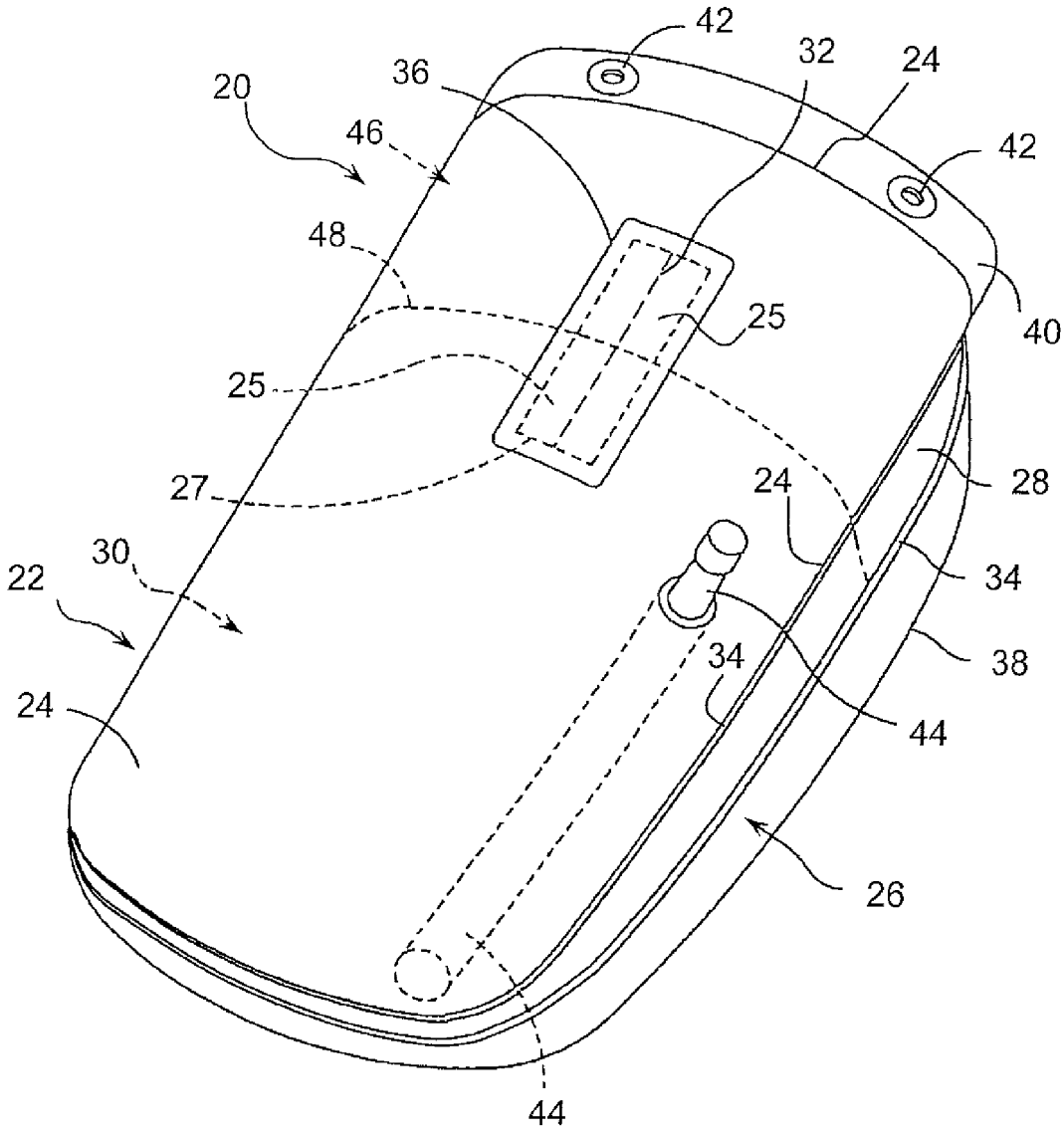
FIG. 1 is a diagrammatic perspective view of one form of container constituting a bag assembly illustrative of an embodiment of the invention.

Referring to FIG. 1, it will be seen that the improved container comprises a flexible bag assembly 20 for containment and selective dispersal of liquid, such as water.

The assembly 20 includes a water-proof and air-tight bag 22 having front and back panels 24, 26 and a peripheral side panel 28. The panels 24, 26, 28 define a chamber 30 internally thereof.

A water-proof and air tight heavy duty zipper 32 is disposed on the front panel 24. The zipper 32 is mounted in a zipper panel 25 fixed hermetically to the front panel 24 by seams 27 sealed with silicone on silicone adhesive.

The panels 24, 26, 28 preferably are of a CORDURA® fabric-like material, such as silicone treated CORDURA® fabric, or silicone fabric, providing high strength and high abrasion resistance. CORDURA® fabric is a high performance, super-durable nylon fabric which provides endurance and rugged durability for equipment exposed to extreme conditions, and is resistant to punctures, cuts, tears and scuffs. The panels are joined together at sealed seams 34 by heavy duty stitching, preferably sealed with a silicone adhesive. In addition to being of high strength and highly abrasion resistance, the material of the panels is inexpensive, permanently mildew-free, and is sufficiently flexible to render the bag collapsible, when empty.

The panels 24, 26, 28 may be of unidirectional nylon woven material, ranging from 500 to 1000 Denier (that is, of a mass of 500-1000 grams per 9000 meters of yarn) which provides mildew resistance to water over a wide range of environments. The interior surfaces of the panels 24, 26, 28 may also be provided with a thin film of anti-microbial material for maintaining the freshness and quality of contained water.

A detachable cover member 36 is fixable to an outside surface of the front panel 24 and is sized and configured to cover the zipper 32. The cover member 36 and the front panel outside surface may be provided with hermaphroditic fasteners, such as VELCRO® fastener, for easily affixing the cover member 36 to, and detaching the cover member from, the front panel 24. The zipper 32 is covered to protect the zipper from damage during rough treatment, such as upon impact after an extended free-fall. The cover member 36 is readily detachable to reveal the zipper for manual operation.

The bag 22 may be provided with a strap 38 for handling or carrying by person, pack animal, rope lines, or the like. In addition, the bag 22 is provided with a fabric tab 40 extending from the bag and provided with one or more grommets 42 for receiving a supporting member (not shown), similar to a coat hook, which extends through a grommet and holds the bag in an upright hanging position.

The bag 22 is provided with a closeable and openable tube 44 extending from the chamber 30, through a panel, and outwardly therefrom. The tube 44 is adapted for selective dispersal of liquid from the bag. The tube may be sized and configured for acceptance by the spout of a one quart canteen, or the like, as desired.

When intended for replacing the current standard five gallon water can, the bag 22 is sized to contain five gallons±of water, and an air pocket 46, so as to form a liquid surface 48 within the bag adjacent the air pocket 46 when the bag is hung by the tab 40. The zipper 32 is disposed such that it can be opened from the top thereof downwardly, thus to open a portion of the bag containing air. This allows air to enter the bag as liquid is drawn therefrom via the tube 44.

When the bag 22 is substantially empty, the flexible nature of the bag permits the bag to be compressed into a relatively small volume, compared to its filled volume. The empty bag can be rolled or otherwise re-shaped to fit into other containers.

Further, by fully opening the zipper 32, with the cover 36 removed therefrom, the bag may be pulled through the fully opened zipper to reverse the bag, such that the inside becomes the outside of the bag and can be cleaned for further use.

In use in the field, the bag herein described can be hauled manually, or by pack animal, or vehicle, or helicopter, or the like, to the desired area. In the case of helicopter delivery, the helicopter need not land, but can drop the bags from over hundred foot altitudes and continue out of a hostile zone. After use, empty bags can be rolled and/or compressed and sent for refill, with large numbers of bags requiring relatively little space (compared to current plastic cans).

A still further advantage realized by the new containers is the option of autoclaving the bag, and its contents, without fear of damaging the bag. The bag can be autoclaved to 250° F., which is not an option with the current plastic can. Thus, if clean drinking water is not available, any water that is available can be autoclaved at 250° F. to increase the safety of human consumption thereof.

There is thus provided a new container for liquids, the container providing many advantages not available in the current water container in general use in the military.

It is to be understood that the present invention is by no means limited to the particular construction herein disclosed and/or shown in the drawings, but also comprises any modification or equivalent within the scope of the claims.

What is claimed is:

1. A water-proof air-tight, flexible bag assembly for containing and dispensing liquid, and for surviving an air-drop of up to 100 feet, the assembly comprising:

a bag having a front panel, a back panel, and a peripheral side panel, each said panel having an interior surface and an outer surface, and each said panel being flexible and consisting of silicone nylon fabric, wherein the periphery of the front panel is joined to the side panel at a first scam, said first seam being sealed with a silicone adhesive, and the periphery of the back panel is joined to the side panel at a second seam, said second seam being sealed with a silicone adhesive, said front, back, and side panels being interconnected at said seams, and said seams being sealed with a silicone adhesive for defining a chamber formed by a silicone nylon fabric panel joined to another silicone nylon fabric panel at a seam, said seam being sealed with a silicone adhesive for retaining the liquid, said chamber being further defined by the interior surface of each said panel;

a zipper, being air-tight and water-proof, said zipper being mounted in a zipper panel, said zipper panel being fixed hermetically to the outer surface of the front panel and being sealed to the front panel with an adhesive, said adhesive being silicone on silicone adhesive;

wherein said silicone nylon fabric being flexible for rendering the bag assembly collapsible when said bag assembly is empty; and wherein said fabric consisting of unidirectional woven silicone nylon, ranging from 500 to 1000 Denier, said interior surface of each said panel being coated with an anti-microbial material;

a cover being detachably fixable to the outer surface of the front panel for covering the zipper and providing air-drop impact protection to the zipper; and a tube extending outwardly from said chamber and though a said panel, said tube being closeable and openable, and said tube being for dispersing liquid from the bag;

wherein said chamber for containing a liquid and an air pocket, said liquid and air pocket forming a liquid surface within the bag; and wherein said zipper being disposed such that the zipper opens for opening an air-containing portion of the bag for allowing air to enter the bag as liquid is drawn from the bag through said tube, and said zipper is of sufficient length, when open, for pulling the interior surface of said chamber through the opened zipper for reversing the bag such that the interior surface becomes outside the bag for cleaning the interior surface.

* * * * *